US008299992B2

(12) United States Patent
Chen et al.

(10) Patent No.: US 8,299,992 B2
(45) Date of Patent: Oct. 30, 2012

(54) LIQUID CRYSTAL DISPLAY AND LIQUID CRYSTAL DISPLAY PANEL THEREOF

(75) Inventors: Ken-Ming Chen, Taichung (TW); Chi-Mao Hung, Chiayi (TW); Chao-Liang Lu, Taoyuan (TW)

(73) Assignee: Au Optronics Corporation, Hsinchu (TW)

( * ) Notice: Subject to any disclaimer, the term of this patent is extended or adjusted under 35 U.S.C. 154(b) by 714 days.

(21) Appl. No.: 12/351,863

(22) Filed: Jan. 12, 2009

(65) Prior Publication Data

US 2010/0123652 A1 May 20, 2010

(30) Foreign Application Priority Data

Nov. 14, 2008 (TW) ..... 97144156 A

(51) Int. Cl.
*G09G 3/36* (2006.01)

(52) U.S. Cl. ..... 345/87; 345/98

(58) Field of Classification Search ..... None
See application file for complete search history.

(56) References Cited

U.S. PATENT DOCUMENTS

| | | | | |
|---|---|---|---|---|
| 6,067,064 | A * | 5/2000 | Furuhashi et al. | 345/89 |
| 6,552,707 | B1 | 4/2003 | Fujiyoshi | |
| 7,199,775 | B2 | 4/2007 | Igarashi et al. | |
| 7,420,533 | B2 * | 9/2008 | Yun | 345/96 |
| 7,548,288 | B2 | 6/2009 | Kim et al. | |
| 7,705,840 | B2 | 4/2010 | Wei et al. | |
| 7,999,782 | B2 * | 8/2011 | Lin et al. | 345/100 |
| 2003/0189537 | A1 | 10/2003 | Yun | |
| 2006/0164350 | A1 | 7/2006 | Kim et al. | |
| 2006/0203172 | A1 | 9/2006 | Baek et al. | |
| 2006/0284819 | A1 | 12/2006 | Lin et al. | |
| 2007/0070017 | A1 | 3/2007 | Wei et al. | |
| 2007/0132684 | A1 | 6/2007 | Baek et al. | |
| 2010/0164917 | A1 | 7/2010 | Wei et al. | |
| 2010/0259512 | A1 * | 10/2010 | Lin et al. | 345/204 |
| 2011/0012892 | A1 * | 1/2011 | Chen et al. | 345/214 |
| 2011/0241979 | A1 | 10/2011 | Baek et al. | |

FOREIGN PATENT DOCUMENTS

| | | |
|---|---|---|
| CN | 1941060 A | 4/2007 |
| TW | 200628950 | 8/2006 |
| TW | 200643856 | 12/2006 |
| TW | 200713177 | 4/2007 |
| TW | 200723219 | 6/2007 |

OTHER PUBLICATIONS

"Office Action of Taiwan Counterpart Application", issued on Mar. 27, 2012, p. 1-8, in which the listed references were cited.

* cited by examiner

*Primary Examiner* — K. Wong
(74) *Attorney, Agent, or Firm* — Jianq Chyun IP Office

(57) ABSTRACT

A liquid crystal display (LCD) and an LCD panel thereof are provided. The structure of the pixel array of the present LCD panel is the half source driving (HSD) structure, and by which skillfully layout the coupled relationship between each pixel and each data line, and thereupon the present LCD panel adopting the driving manner of the column inversion can be achieved the display effect of the dot inversion. Therefore, the present invention can substantially reduce the power consumption of the source driver.

19 Claims, 4 Drawing Sheets

LIQUID CRYSTAL DISPLAY AND LIQUID CRYSTAL DISPLAY PANEL THEREOF

CROSS-REFERENCE TO RELATED APPLICATION

This application claims the priority benefit of Taiwan application serial no. 97144156, filed on Nov. 14, 2008. The entirety of the above-mentioned patent application is hereby incorporated by reference herein and made a part of specification.

BACKGROUND OF THE INVENTION

1. Field of the Invention

The present invention relates to a flat panel display technology, more particularly, to a liquid crystal display (LCD) and an LCD panel thereof with the capable of reducing the power consumption of the source driver under the structure of the pixel array of the LDC panel is the half source driving (HSD) structure.

2. Description of the Related Art

In the presence of all structures of the pixel array of the current LCD panel, one specie is so-called the half source driving (hereinafter "HSD") structure. The HSD structure would reduce the number of the data lines to half by which increasing the number of the scan lines to double. Since the number of the data lines is reduced to half, so that the cost of the source driver would be relatively reduced. In general, since the driving manner of the HSD structure's LCD panel must be adopted the dot inversion, so that the driving polarity of each data line would be switched once whenever a pixel row has been written the display data. Therefore, the source driver would be consumed a lot of power.

SUMMARY OF THE INVENTION

The present invention is directed to a liquid crystal display (LCD) and an LCD panel thereof with the capable of reducing the power consumption of the source driver under the structure of the pixel array of the LDC panel is the HSD structure, and the driving manner is adopted the column inversion.

The present invention provides an LCD panel including a plurality of scan lines, a plurality of data lines and a plurality of pixels arranged in matrix. The $(4i+1)^{th}$ scan line is coupled to the $(4j+1)^{th}$ and $(4j+2)^{th}$ pixels of the $(2i+1)^{th}$ pixel row, where i is a positive integer which is larger than or equal to 0, and j is a positive integer which is larger than or equal to 0. The $(4i+2)^{th}$ scan line is only coupled to the $(4j+3)^{th}$ and $(4j+4)^{th}$ pixels of the $(2i+1)^{th}$ pixel row. The $(4i+3)^{th}$ scan line is only coupled to the $(4j+2)^{th}$ and $(4j+3)^{th}$ pixels of the $(2i+2)^{th}$ pixel row. The $(4i+4)^{th}$ scan line) is only coupled to the $(4j+4)^{th}$ and $(4j+5)^{th}$ pixels of the $(2i+2)^{th}$ pixel row. The $(2r+1)^{th}$ data line is only coupled to the $s^{th}$ pixel of the $(4r+1)^{th}$ pixel column and the $(4r+3)^{th}$ pixel column, and the $k^{th}$ pixel of the $(4r+2)^{th}$ pixel column and the $(4r+4)^{th}$ pixel column, where r is a positive integer which is larger than or equal to 0, s is a positive odd integer, and k is a positive even integer. The $(2r+2)^{th}$ data line is only coupled to the $s^{th}$ pixel) of the $(4r+2)^{th}$ pixel column and the $(4r+4)^{th}$ pixel column, and the $k^{th}$ pixel of the (4r+3 pixel column and the $(4r+5)^{th}$ pixel column.

The present invention also provides an LCD having the present LCD panel therein.

The structure of the pixel array of the present LCD panel is the half source driving (HSD) structure, and by which skillfully layout the coupled relationship between each pixel and each data line, and thereupon the present LCD panel adopting the driving manner of the column inversion can be achieved the display effect of the dot inversion. Therefore, the present invention can substantially reduce the power consumption of the source driver.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
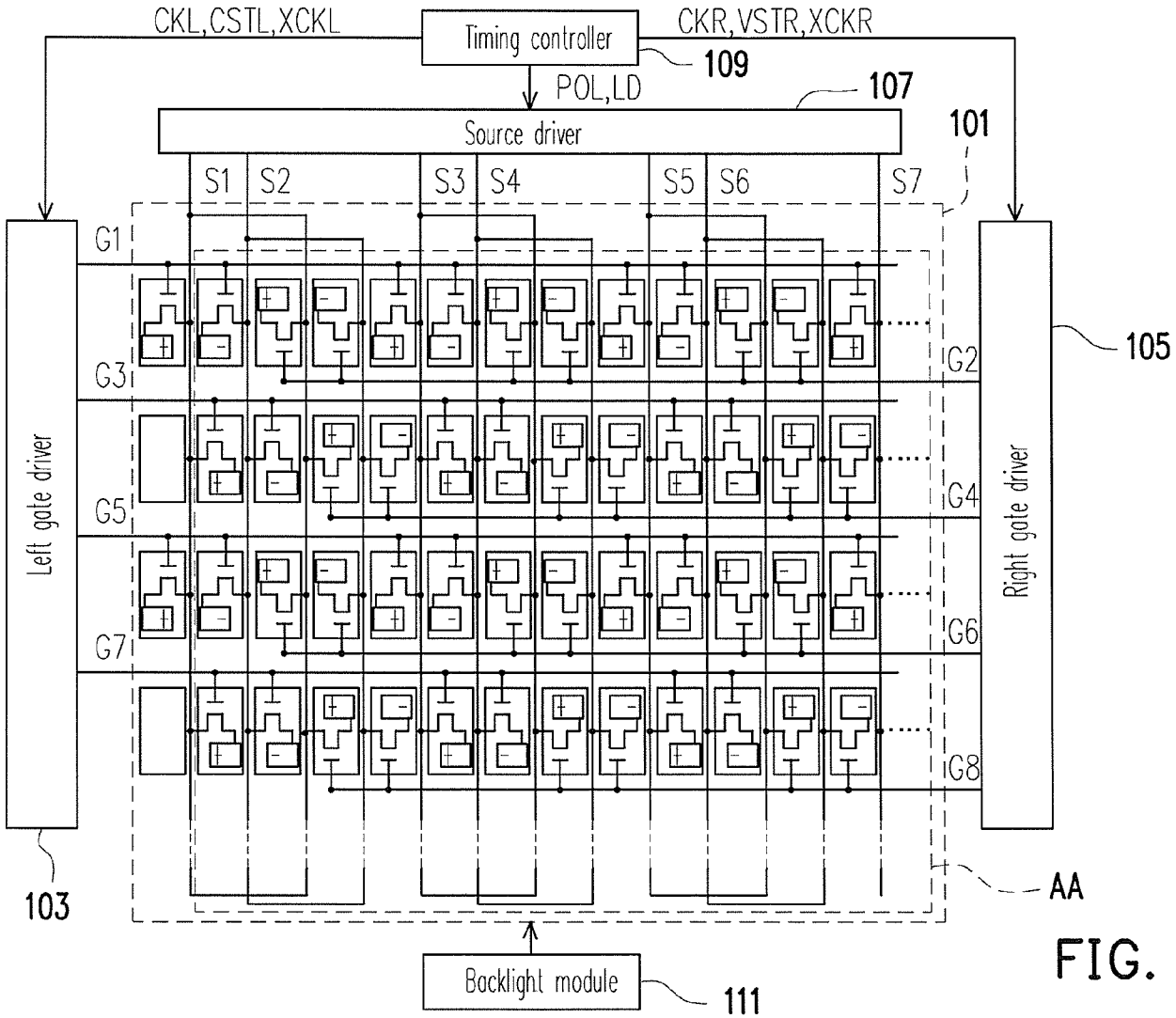
FIG. 1 is a system block diagram of an LCD according to an embodiment of present invention.

Reference will now be made in detail to the present preferred embodiments of the invention, examples of which are illustrated in the accompanying drawings.

The present invention provides an LCD and an LCD panel thereof with the capable of reducing the power consumption of the source driver under the structure of the pixel array of the LDC panel is the HSD structure. Below, the characteristics and advantages of the technique in the present invention will be described in detail. Wherever possible, the same reference numbers are used in the drawings and the description to refer to the same or like parts.

FIG. 1 is a system block diagram of an LCD 100 according to an embodiment of present invention. Referring to FIG. 1, the LCD 100 includes an LCD panel 101, a left gate driver 103, a right gate driver 105, a source driver 107, a timing controller 109 and a backlight module 111 for providing the surface light source to the LCD panel 101. The LCD panel 101 includes a plurality of scan lines G1~G8 (only eight scan lines are shown in FIG. 1, but not limited thereto), a plurality of data lines S1~S7 (only seven data lines are shown in FIG. 1, but not limited thereto) and a plurality of pixels Pix arranged in matrix (but not limited the number of the pixels shown in FIG. 1 thereto).

In the present embodiment, the $(4i+1)^{th}$ scan line is coupled to the $(4j+1)^{th}$ and $(4j+2)^{th}$ pixels of the $(2i+1)^{th}$ pixel row, where i is a positive integer which is larger than or equal to 0, and j is a positive integer which is larger than or equal to 0. The $(4i+2)^{th}$ scan line is only coupled to the $(4j+3)^{th}$ and $(4j+4)^{th}$ pixels of the $(2i+1)^{th}$ pixel row. The $(4i+3)^{th}$ scan line is only coupled to the $(4j+2)^{th}$ and $(4j+3)^{th}$ pixels of the $(2i+2)^{th}$ pixel row. The $(4i+4)^{th}$ scan line is only coupled to the $(4j+4)^{th}$ and $(4j+5)^{th}$ pixels of the $(2i+2)^{th}$ pixel row. The $(2r+1)^{th}$ data line is only coupled to the $s^{th}$ pixel of the $(4r+1)^{th}$ pixel column and the $(4r+3)^{th}$ pixel column, and the $k^{th}$ pixel of the $(4r+2)^{th}$ pixel column and the $(4r+4)^{th}$ pixel column, where r is a positive integer which is larger than or equal to 0, s is a positive odd integer, and k is a positive even integer. The $(2r+2)^{th}$ data line is only coupled to the $s^{th}$ pixel of the $(4r+2)^{th}$ pixel column and the $(4r+4)^{th}$ pixel column, and the $k^{th}$ pixel of the $(4r+3)^{th}$ pixel column and the $(4r+5)^{th}$ pixel column.

It should be noted that the number of all of the scan lines within the LCD panel 101 would be even; the number of all of the data lines within the LCD panel 101 would be odd; and the $(4r+1)^{th}$ pixel column of the pixels arranged in matrix within the LCD panel 101 is not within a display area AA of the LCD panel 101. The $(4r+1)^{th}$ pixel column of the pixels arranged in matrix within the LCD panel 101 is used for balancing the load.

From the above, it can be known that the structure of the pixel array of the LCD panel 101 is the HSD structure, so that the number of the scan lines would be increased to double, and the number of the data lines would be reduced to half. Therefore, since the number of the data lines would be reduced to half, so that the cost of the source driver 107 would be relatively reduced.

In addition, since the number of the scan lines would be increased to double, so that the left and the right gate drives 103 and 105 of the present embodiment can be directly disposed on the glass substrate of the LCD panel 101, and adopted bilateral driving manner to drive the scan lines so as to effectively reduce the manufacture cost of the gate driver.

In the present embodiment, the left gate driver 103 is disposed at a side of the LCD panel 101 and coupled to the LCD panel 101, for sequentially providing the first scan signal to all odd scan lines of all scan lines within the LCD panel 101. The operation of the left gate driver 103 is controlled by the control signals CKL, XSTL and XCKL provided by the timing controller 109.

The right gate driver 105 is disposed at an another side of the LCD panel 101 and coupled to the LCD panel 101, for sequentially providing the second scan signal to all even scan lines of all scan lines within the LCD panel 101. The operation of the right gate driver 105 is controlled by the control signals CKR, XSTR and XCKR provided by the timing controller 109.

The source driver 109 is coupled to the LCD panel 101 and controlled by at least the control signals LD and POL provided by the timing controller 109 for providing the corresponding display data (OP_data) to each data line S1~S7, so that each pixel column within the LCD panel 101 would receive the corresponding display data via the data lines S1~S7 respectively.

Figure 2:
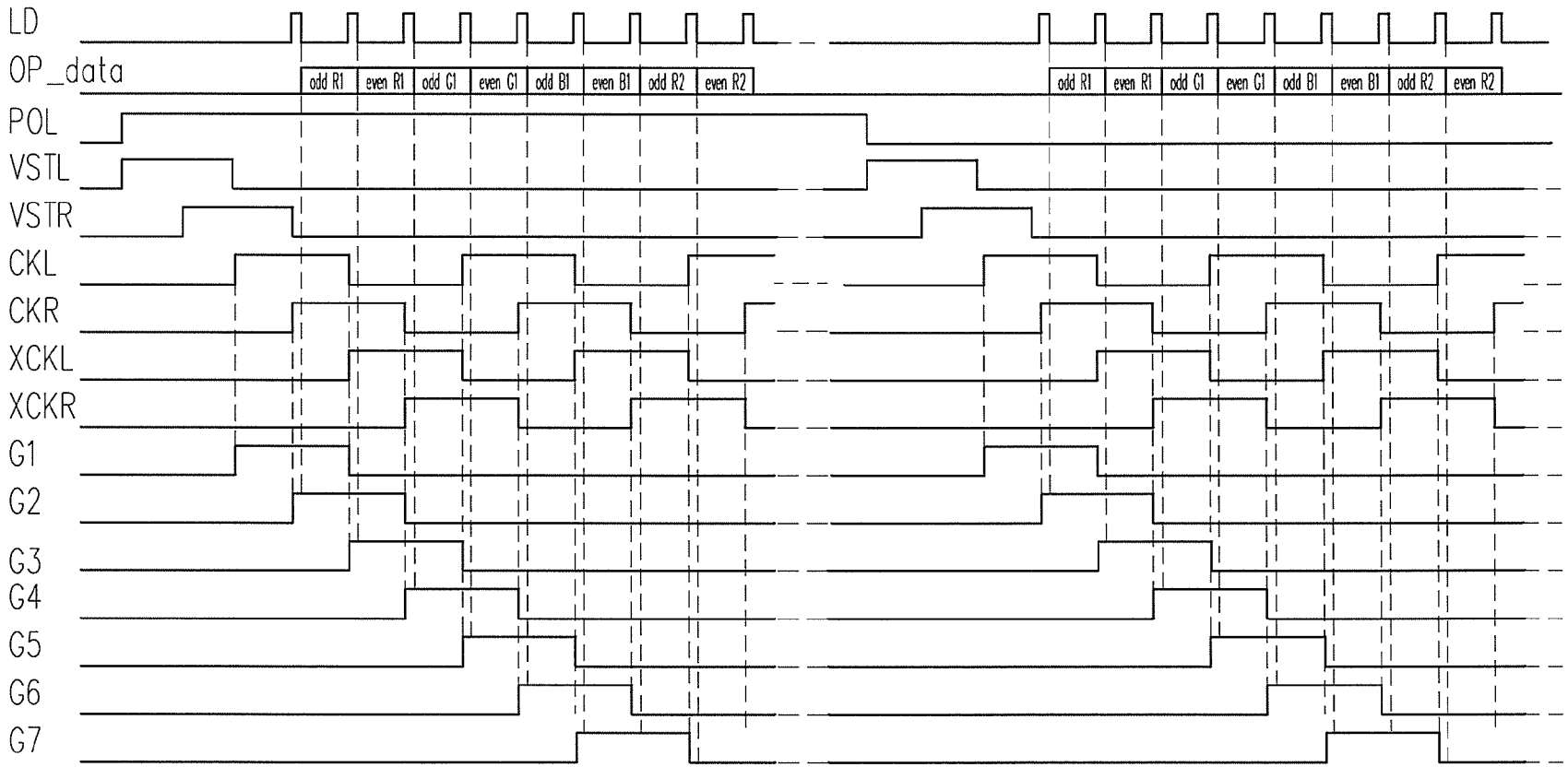
FIG. 2 is a part of the driving timing chart of the LCD according to an embodiment of the present invention.

For clearly explaining the operation of the LCD 100, FIG. 2 is a part of the driving timing chart of the LCD 100 according to an embodiment of the present invention. Referring to FIG. 1 and FIG. 2 both, it can be simply seen from FIG. 2, the left and the right gate driver 103 and 105 are respectively controlled by the control signals CKL, XSTL, XCKL and CKR, XSTR, XCKR provided by the timing controller 109, and alternately co-operated for sequentially providing the scan signals (i.e. the above-mentioned first and the second scan signals) to the corresponding scan lines G1~G8 within the LCD panel 101.

In addition, the source driver 109 is controlled by at least the control signals LD and POL provided by the timing controller 109 for providing the corresponding display data OP_data to each data line S1~S7, so that each pixel column within the LCD panel 101 would receive and write-in the corresponding display data via the data lines S1~S7 respectively.

Even though the structure of the pixel array of the LCD panel 101 in the present embodiment is the HSD structure, but it can be seen from FIG. 2, the control signal POL, which is used for determining the driving polarity of each data line S1~S7, is merely switched once at a frame period of the LCD 100, so that the present invention is different to when the traditional HSD structure's LCD panel is adopted the driving manner of the dot inversion, the driving polarity of each data line would be switched once whenever a pixel row has been written the display data, so as to cause the source driver would be consumed a lot of power. Therefore, the driving manner of the LCD panel 101 in the present embodiment can be adopted the column inversion to achieve the display effect of the dot inversion, so that the power consumption of the source driver 107 would be substantially reduced.

Figure 3:
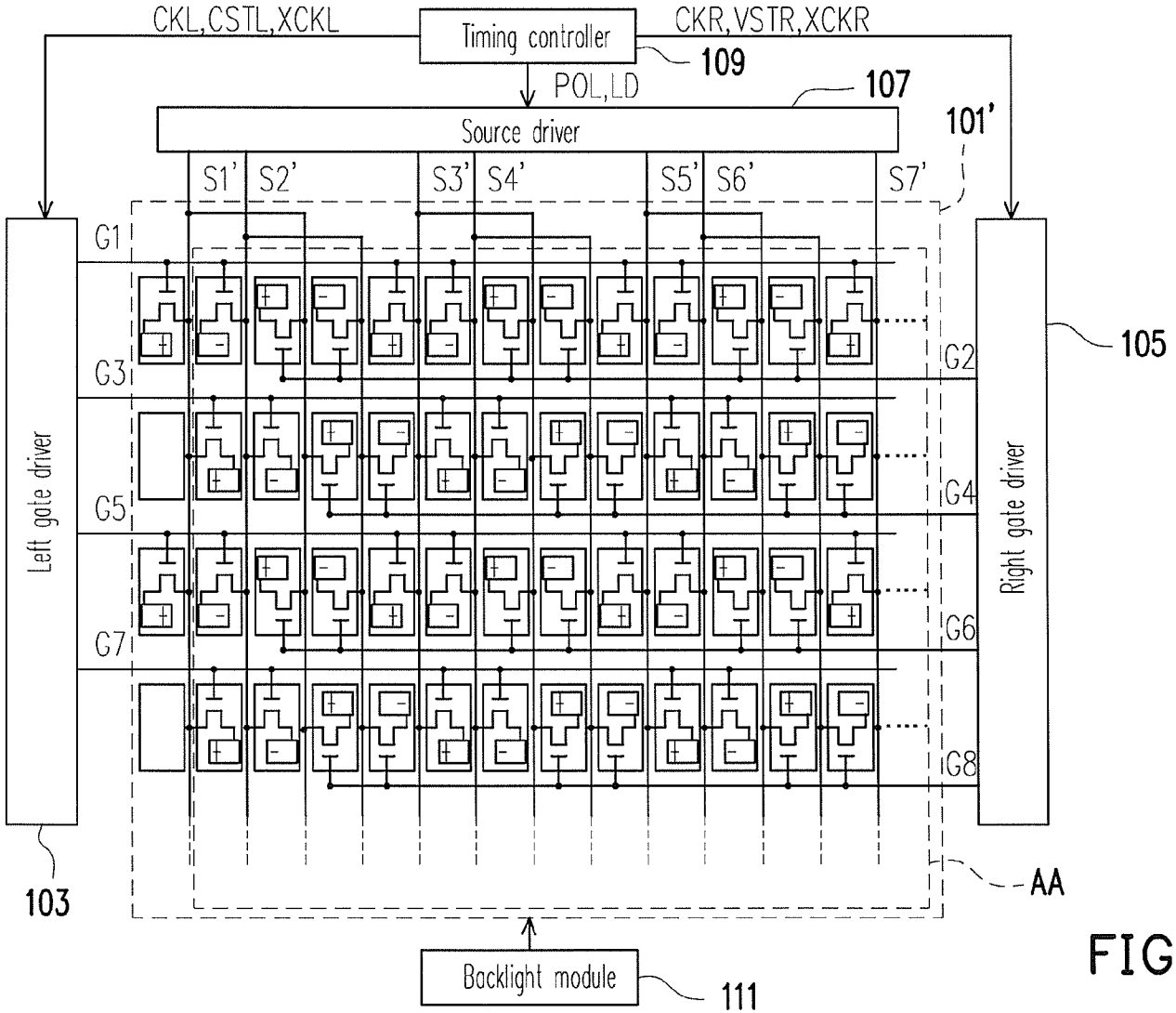
FIG. 3 and FIG. 4 are a system block diagram of LCDs according to other embodiments of the present invention.
Figure 4:
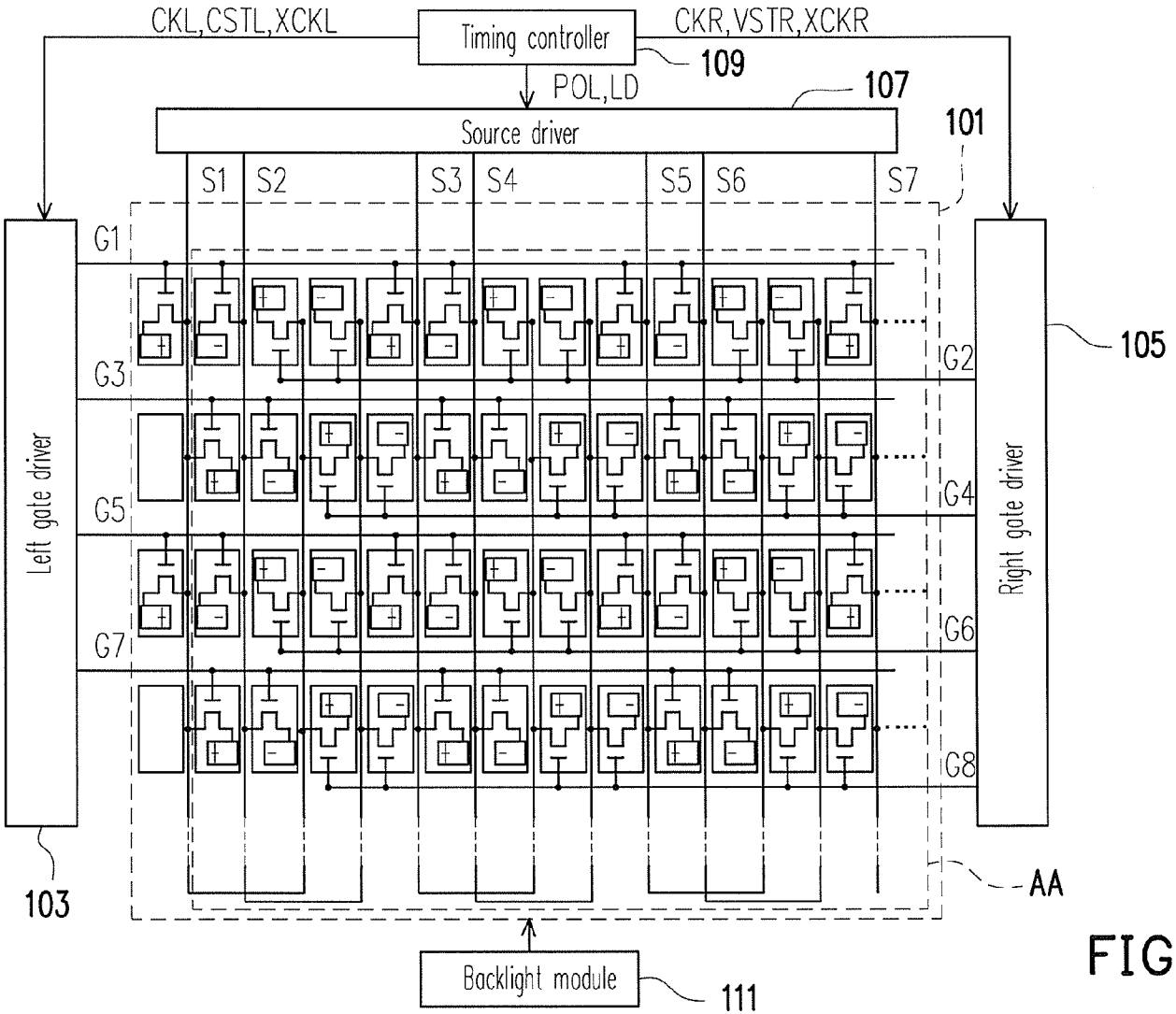

FIG. 3 and FIG. 4 are a system block diagram of LCDs 300 and 400 according to other embodiments of the present invention. Referring to FIG. 1, FIG. 3 and FIG. 4, the LCDs 300 and 400 are substantially similar to the LCD 100. The difference between the LCDs 100, 300 and 400 is the wire manner of the data lines. To be specific, the wire manner of each data line S1~S7 of the LCD 100 is the circle wire, and the wire manner of each data lines S1'~S7' is the terminal wire, but the LCDs 300 and 400 would be substantially achieved the technical efficiency similar to the LCD 100.

In summary, The structure of the pixel array of the present LCD panel is the half source driving (HSD) structure, and by which skillfully layout the coupled relationship between each pixel and each data line, and thereupon the present LCD panel adopting the driving manner of the column inversion can be achieved the display effect of the dot inversion. Therefore, the present invention can substantially reduce the power consumption of the source driver.

It will be apparent to those skills in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A liquid crystal display (LCD) panel, comprising:

a plurality of scan lines;

a plurality of data lines; and a plurality of pixels, arranged in matrix;

wherein the $(4i+1)^{th}$ scan line is only coupled to the $(4j+1)^{th}$ and $(4j+2)^{th}$ pixels of the $(2i+1)^{th}$ pixel row, where i is a positive integer which is larger than or equal to 0, and j is a positive integer which is larger than or equal to 0;

the $(4i+2)^{th}$ scan line is only coupled to the $(4j+3)^{th}$ and $(4j+4)^{th}$ pixels of the $(2i+1)^{th}$ pixel row;

the $(4i+3)^{th}$ scan line is only coupled to the $(4j+2)^{th}$ and $(4j+3)^{th}$ pixels of the $(2i+2)^{th}$ pixel row;

the $(4i+4)^{th}$ scan line is only coupled to the $(4j+4)^{th}$ and $(4i+5)^{th}$ pixels of the $(2i+2)^{th}$ pixel row;

the $(2r+1)^{th}$ data line is only coupled to the $s^{th}$ pixel of the $(4r+1)^{th}$ pixel column and the $(4r+3)^{th}$ pixel column, and the $k^{th}$ pixel of the $(4r+2)^{th}$ pixel column and the $(4r+4)^{th}$ pixel column, where r is a positive integer which is larger than or equal to 0, s is a positive odd integer, and k is a positive even integer; and the $(2r+2)^{th}$ data line is only coupled to the $s^{th}$ pixel of the $(4r+2)^{th}$ pixel column and the $(4r+4)^{th}$ pixel column, and the $k^{th}$ pixel of the $(4r+3)^{th}$ pixel column and the $(4r+5)^{th}$ pixel column.

2. The LCD panel according to claim 1, wherein the number of the scan lines is even.

3. The LCD panel according to claim 2, wherein all odd scan lines in the scan lines are used for sequentially receiving a first scan signal.

4. The LCD panel according to claim 3, wherein all even scan lines in the scan lines are used for sequentially receiving a second scan signal.

5. The LCD panel according to claim 1, wherein the number of the data lines is odd.

6. The LCD panel according to claim 5, wherein the $(4r+1)^{th}$ pixel column in the pixels is not within a display area of the LCD panel.

7. A liquid crystal display (LCD), comprising:

an LCD panel, comprising:

a plurality of scan lines;

a plurality of data lines; and a plurality of pixels, arranged in matrix;

wherein the $(4i+1)^{th}$ scan line is coupled to the $(4j+1)^{th}$ and $(4j+2)^{th}$ pixels of the $(2i+1)^{th}$ pixel row, where i is a positive integer which is larger than or equal to 0, and j is a positive integer which is larger than or equal to 0;

the $(4i+2)^{th}$ scan line is only coupled to the $(4j+3)^{th}$ and $(4j+4)^{th}$ pixels of the $(2i+1)^{th}$ pixel row;

the $(4i+3)^{th}$ scan line is only coupled to the $(4j+2)^{th}$ and $(4j+3)^{th}$ pixels of the $(2i+2)^{th}$ pixel row;

the $(4i+4)^{th}$ scan line is only coupled to the $(4j+4)^{th}$ and $(4j+5)^{th}$ pixels of the $(2i+2)^{th}$ pixel row;

the $(2r+1)^{th}$ data line is only coupled to the $s^{th}$ pixel of the $(4r+1)^{th}$ pixel column and the $(4r+3)^{th}$ pixel column, and the $k^{th}$ pixel of the $(4r+2)^{th}$ pixel column and the $(4r+4)^{th}$ pixel column, where r is a positive integer which is larger than or equal to 0, s is a positive odd integer, and k is a positive even integer; and the $(2r+2)^{th}$ data line is only coupled to the $s^{th}$ pixel of the $(4r+2)^{th}$ pixel column and the $(4r+4)^{th}$ pixel column, and the $k^{th}$ pixel of the $(4r+3)^{th}$ pixel column and the $(4r+5)^{th}$ pixel column.

8. The LCD according to claim 7, wherein the number of the scan lines is even.

9. The LCD according to claim 8, wherein all odd scan lines in the scan lines are used for sequentially receiving a first scan signal.

10. The LCD according to claim 9, further comprising:

a first gate driver, disposed at a side of the LCD panel and coupled to the LCD panel, for sequentially providing the first scan signal.

11. The LCD according to claim 10, wherein all even scan lines in the scan lines are used for sequentially receiving a second scan signal.

12. The LCD according to claim 11, further comprising:

a second gate driver, disposed at an another side of the LCD panel and coupled to the LCD panel, for sequentially providing the second scan signal.

13. The LCD according to claim 12, wherein each pixel column within the LCD panel correspondingly receives a display data via the data lines respectively.

14. The LCD according to claim 13, wherein a driving polarity of the display data received by each pixel column within the LCD panel is switched once at a frame period of the LCD.

15. The LCD according to claim 13, further comprising:

a source driver, coupled to the LCD panel, for correspondingly providing the display data to the data lines.

16. The LCD according to claim 15, further comprising:

a timing controller, coupled to the first and the second gate drivers and the source driver, for controlling the operation of the first and the second gate drivers and the source driver.

17. The LCD according to claim 7, further comprising:

a backlight module, for providing a surface light source to the LCD panel.

18. The LCD according to claim 7, wherein the number of the data lines is odd.

19. The LCD according to claim 18, wherein the $(4r+1)^{th}$ pixel column in the pixels is not within a display area of the LCD panel.

* * * * *